US008888015B2

(12) United States Patent
Rayner

(10) Patent No.: US 8,888,015 B2
(45) Date of Patent: Nov. 18, 2014

(54) SPRAY BAR AND FILTER APPARATUS

(75) Inventor: Richard D Rayner, Folsom, CA (US)

(73) Assignee: Richard D. Rayner, Folsom, CA (US)

( * ) Notice: Subject to any disclaimer, the term of this patent is extended or adjusted under 35 U.S.C. 154(b) by 718 days.

(21) Appl. No.: 12/319,701

(22) Filed: Jan. 12, 2009

(65) Prior Publication Data

US 2010/0123028 A1 May 20, 2010

Related U.S. Application Data

(60) Provisional application No. 61/199,622, filed on Nov. 19, 2008.

(51) Int. Cl.

| | |
|---|---|
| ***B05B 15/02*** | (2006.01) |
| ***B05B 1/20*** | (2006.01) |
| ***B05B 1/14*** | (2006.01) |
| ***B05B 1/30*** | (2006.01) |
| ***E01C 19/17*** | (2006.01) |
| ***B05B 15/00*** | (2006.01) |

(52) U.S. Cl.

CPC ..... *E01C 19/176* (2013.01); *B05B 15/008* (2013.01); *B05B 1/20* (2013.01); *B05B 15/02* (2013.01)

USPC ..... 239/106; 239/159; 239/550; 239/553.3; 239/553.5; 239/574; 239/575; 239/581.1

(58) Field of Classification Search

CPC ..... E01C 19/176; B05B 15/008; B05B 1/20; B05B 15/02; A01G 25/16; F16K 31/44; H01L 21/67028; B08B 3/022; Y10S 134/902

USPC ..... 239/548, 550, 553, 553.3, 553.5, 551, 239/569, 574, 575, 581.1, 159; 404/83–133.2; 137/862, 883, 615, 616, 137/616.7

See application file for complete search history.

(56) References Cited

U.S. PATENT DOCUMENTS

| | | | | | |
|---|---|---|---|---|---|
| 1,017,533 | A * | 2/1912 | Goodlett | 239/417 |
| 1,033,416 | A * | 7/1912 | Kemp et al. | 239/128 |
| 1,364,555 | A * | 1/1921 | Hunt | 137/862 |
| 1,663,263 | A * | 3/1928 | Sharp | 239/117 |
| 2,153,356 | A * | 4/1939 | Walker | 239/551 |
| 2,197,231 | A * | 4/1940 | Walker | 239/551 |
| 2,461,617 | A * | 2/1949 | Waters | 251/340 |
| 2,571,583 | A * | 10/1951 | Kolbach | 239/537 |
| 3,095,151 | A * | 6/1963 | MacChesney | 239/267 |
| 3,436,024 | A * | 4/1969 | Gregg, Sr. | 239/553.3 |
| 3,746,038 | A * | 7/1973 | Simmons | 137/513.5 |
| 3,822,040 | A * | 7/1974 | Hibbard | 239/86 |
| 4,734,188 | A * | 3/1988 | Burdette et al. | 210/107 |
| 4,880,168 | A * | 11/1989 | Randall et al. | 239/553.5 |
| 5,028,007 | A * | 7/1991 | Wokal | 239/518 |
| 5,094,612 | A * | 3/1992 | Vallat | 431/280 |
| 6,250,318 | B1 * | 6/2001 | Kiat et al. | 134/72 |

* cited by examiner

*Primary Examiner* — Jason Boeckmann
*Assistant Examiner* — Steven M Cernoch

(57) ABSTRACT

The object of the present invention is to provide a spraying apparatus with an integrated filter, specifically to overcome the challenges of spraying asphalt sealant material. The present invention can be integrated within an asphalt sealant spray system and consists of a leak free large filter housing, multiple spray nozzles placed axially and pointing downwards towards the ground, a meshed filter that fits inside the filter housing, an actuator as means of on/off nozzle control, extension options for lengthening the spray pattern, a material inlet that will receive pressurized material from a pump the spray apparatus is integrated with, and housing end caps to provide easy access to the inside of the filter housing.

1 Claim, 5 Drawing Sheets

SPRAY BAR AND FILTER APPARATUS

CROSS REFERENCE TO RELATED APPLICATION

This application claims the benefit of my earlier filed provisional application U.S. No. 61/199,622

FIELD OF THE INVENTION

The present invention primarily relates to an integral spray nozzle system and filter apparatus, and in more particularly to the application of asphalt sealant material, which can be used within an asphalt sealant application system. The apparatus also contains actuator on/off capability and spray pattern extension options.

BACKGROUND OF THE INVENTION

The application of liquid material to the ground surface is generally accomplished through a system where material is pumped from a material tank to a spray bar consisting of a multiplicity of nozzles pointing towards the ground surface. Where past spray systems define the method of the spray system they do not specifically define the spray bar apparatus itself.

The asphalt industry has yet to be introduced to a spray bar apparatus specifically for asphalt sealant material. Asphalt sealant material is a unique substance. When applied through spray nozzles, asphalt sealant material must be filtered to prevent the nozzles from clogging. Past spray systems have introduced a filter to the process in a variety of ways. One method of filtration has been accomplished by means of a separate filter system. The material first flows through a separate filter and secondly through the spray bar. Another method has been to incorporate the filter into the nozzle itself.

The past inventions do not address the specific challenges of applying asphalt sealant material include material build up and the ease of cleaning the material build up. The present invention introduces a new method of filtering within the spray apparatus, and simple method of cleaning the filtered material.

In addition, the present invention provides actuator on/off control of the spray nozzles and a method of lengthening the desired spray pattern through extension options.

SUMMARY OF THE INVENTION

The asphalt industry has yet been introduced to a spray apparatus specifically for asphalt sealant material. The object of the present invention is to provide a spraying apparatus with an integrated filter, specifically to overcome the challenges of spraying asphalt sealant material.

The present invention can be integrated within an asphalt sealant spray system and consists of a leak free large filter housing, multiple spray nozzles placed axially and pointing downwards towards the ground, a meshed filter that fits inside the filter housing, an actuator as means of on/off nozzle control, extension options for lengthening the spray pattern, a material inlet that will receive pressurized material from a pump the spray apparatus is integrated with, and housing end caps to provide easy access to the inside of the filter housing.

DESCRIPTION OF PREFERRED EMBODIMENTS

This filter spray apparatus is to be used within a paving system using a product pump as a source for material flow, and can be mounted accordingly to work with the provided spray system.

Figure 1:
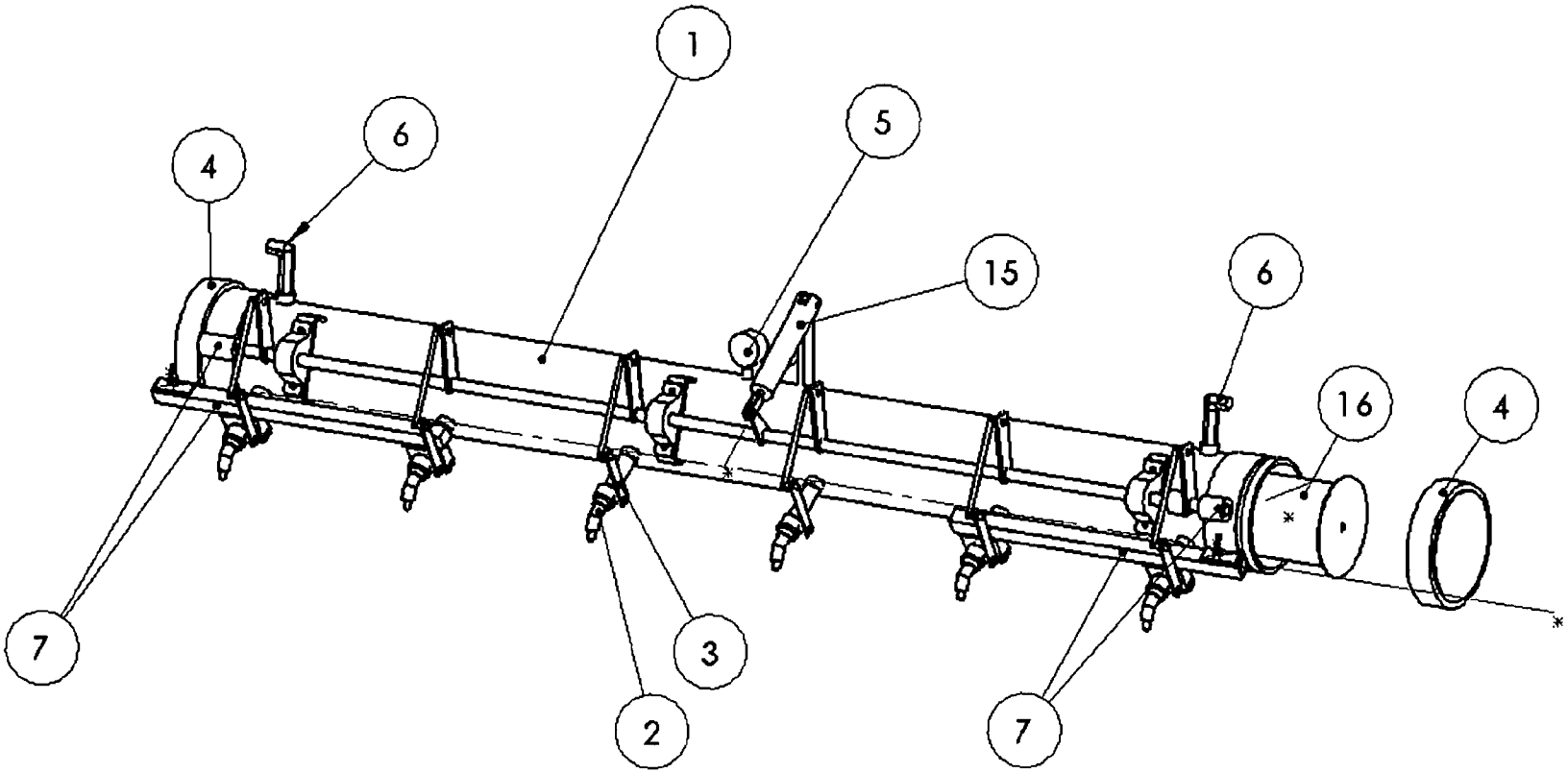
FIG. 1 Diagrams general placement of components within apparatus.

Refer to FIG. 1 unless otherwise noted. The apparatus consists of a filter housing (1) with multiple nozzles (2), an integrated mesh filter screen (16) within the filter housing, detachable end pieces (4), an actuator (15) for on/off spray control, and extension options (see FIG. 2) for lengthening the spray pattern.

The filter housing (1) serves as means for containing and conveying asphalt sealant material. Multiple nozzles (2) are longitudinally aligned along the filter housing, each nozzle having a valve (3) as means for on/off flow control. The ends of the filter housing have detachable end caps (4) which provide access to the inside of the housing. A material inlet (see FIGS. 1*b*-8) is located on the filter housing where the material can easily be pumped into the spray apparatus. Additional features of the filter housing include a pressure gage attachment (5), 2 material outlet ports (6) as means for conveying material to the extensions, means for attaching the extensions (7), and a leak-free design.

Figure 1A:
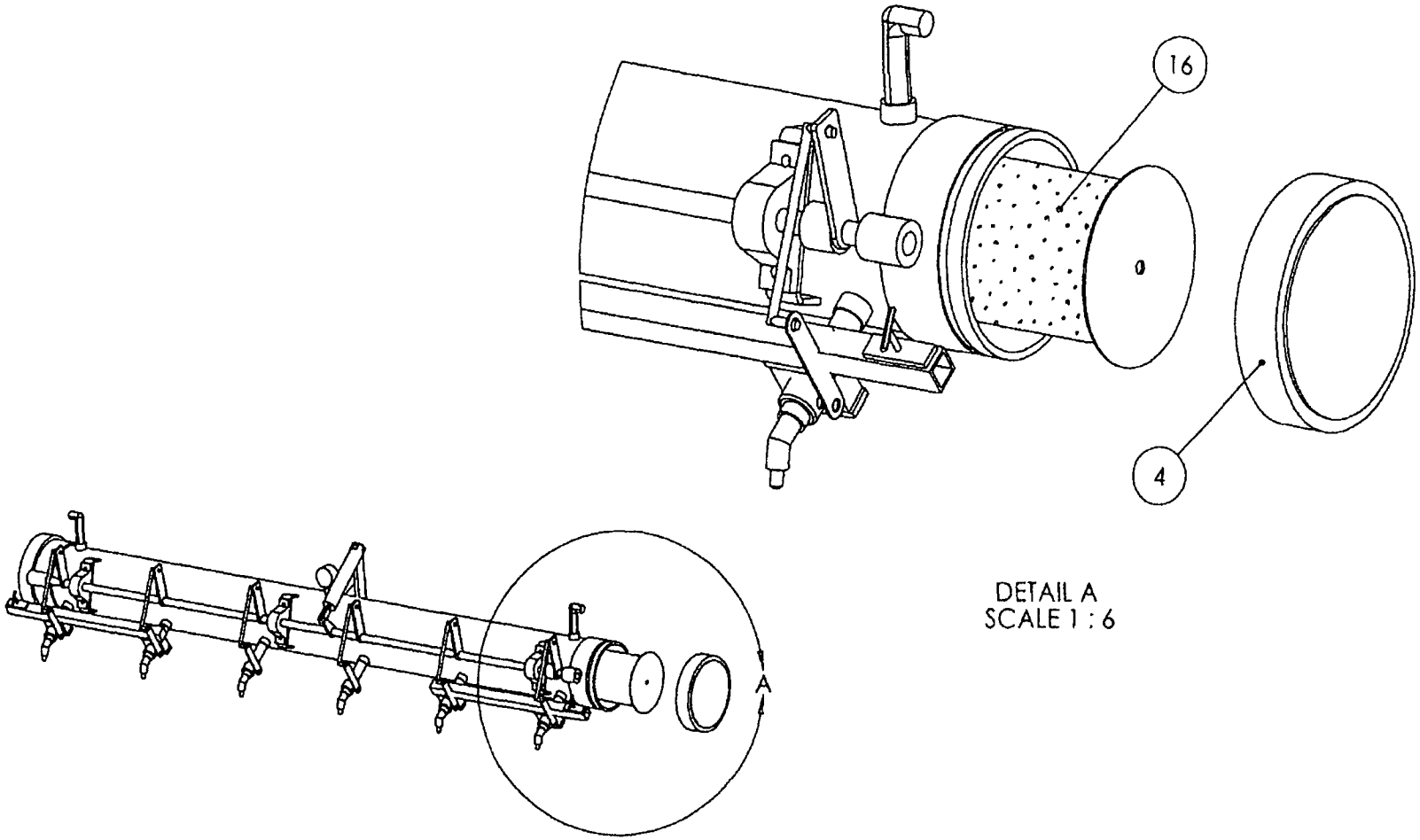
FIG. 1*a* Detailed close up of FIG. 1 showing filter and end cap.
Figure 1B:
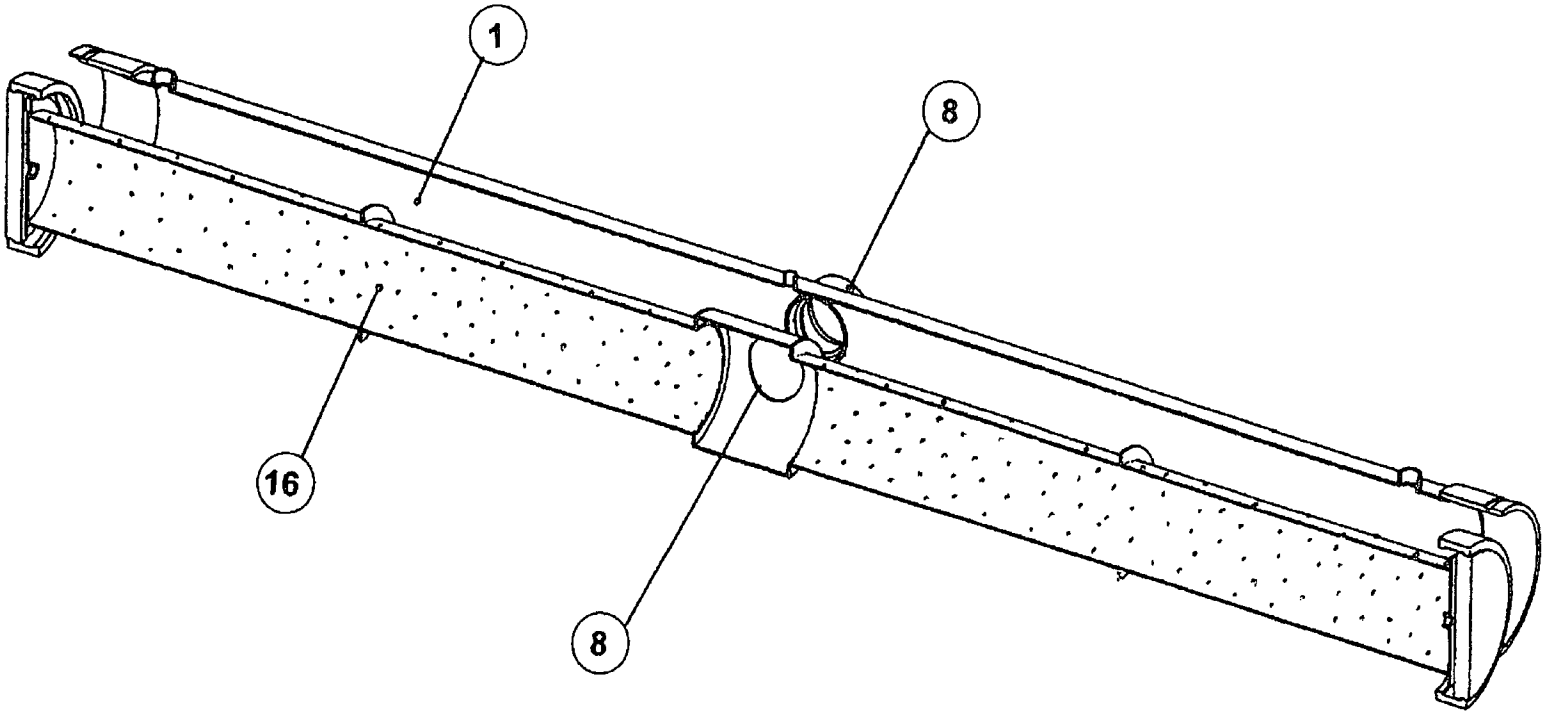
FIG. 1*b* Cut out and exploded view of inside of the filter housing.

Now refer to FIG. 1*a* and FIG. 1*b* unless otherwise noted. The filtration feature of the spray apparatus begins at the material inlet (8) where material can flow into the filter housing from a pump provided by the spray system the spray apparatus is integrated with. A filter (16) is placed inside of the filter housing. The filter is made of a mesh type material with, ideally, smaller holes than the hole diameters of the nozzle outlets, and is the same length of the main housing. Once the material enters the housing it first flows into the filter. The material then filters radially outward through the filter screen and then proceeds to the spray heads. The material that was filtered out of the material collects inside of the filter screen.

The outstanding aspect of this filter spray apparatus is the ease maintenance. The ends of the housing can be detached (4), which provides easy access to the filter and the inside of the spray apparatus. The user simply must take off the end piece and can remove the filter for cleaning.

Figure 2:
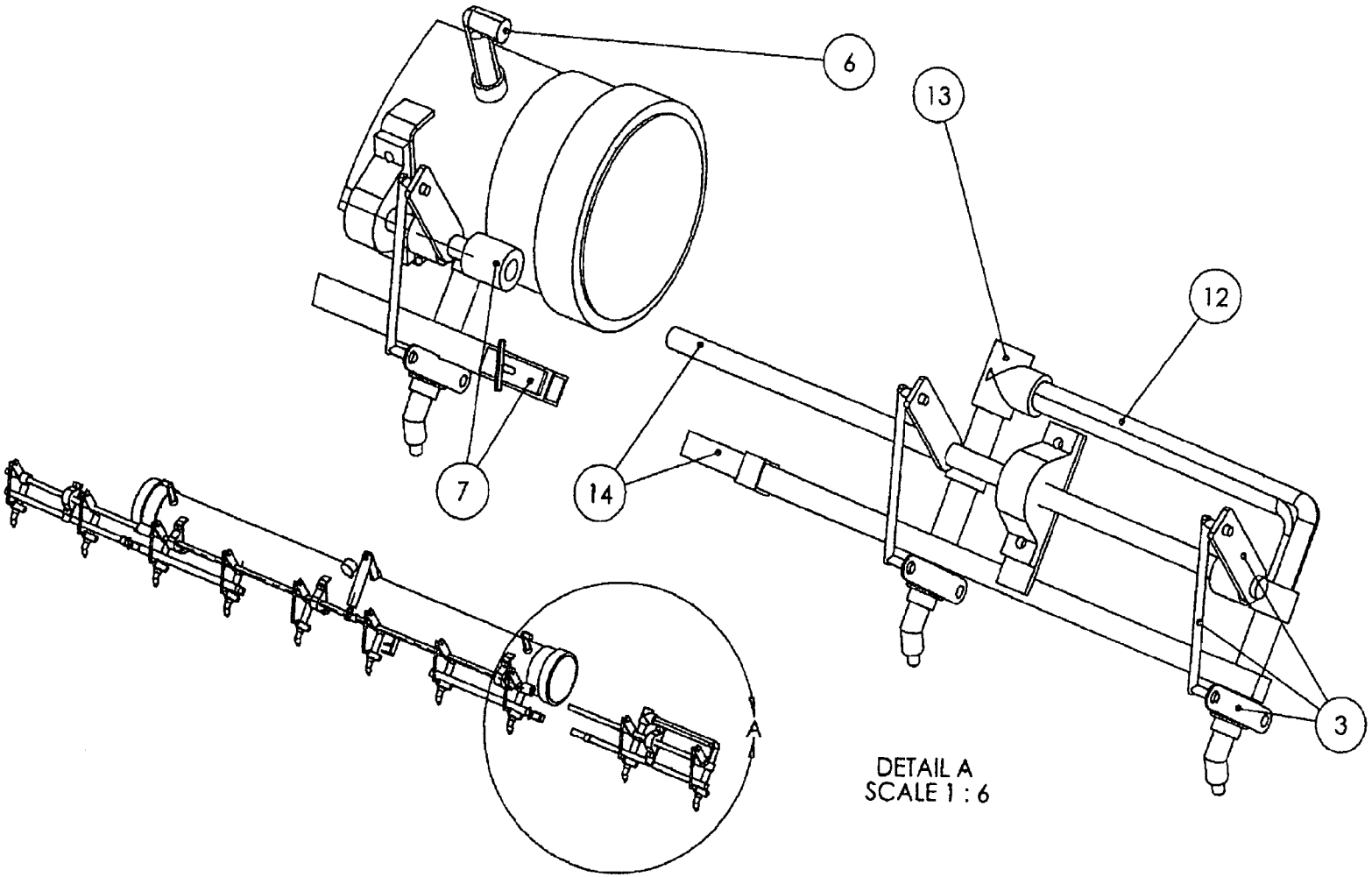
FIG. 2 Diagram of extension option.

Now refer to FIG. 2 unless otherwise noted. The extensions serve as means for extending the spray pattern. They consist of one or more nozzles (2) that, when attached to the spray apparatus, line-up laterally and mirror the nozzle pattern on the filter housing. They consist of the same bearings, linkages, and shaft configurations (3) as on the spray apparatus itself. Piping connects the nozzles together (12) and connects the nozzles to the filter housing at the outlet ports (13 and 6) to allow material flow to the extensions.

Figure 3:
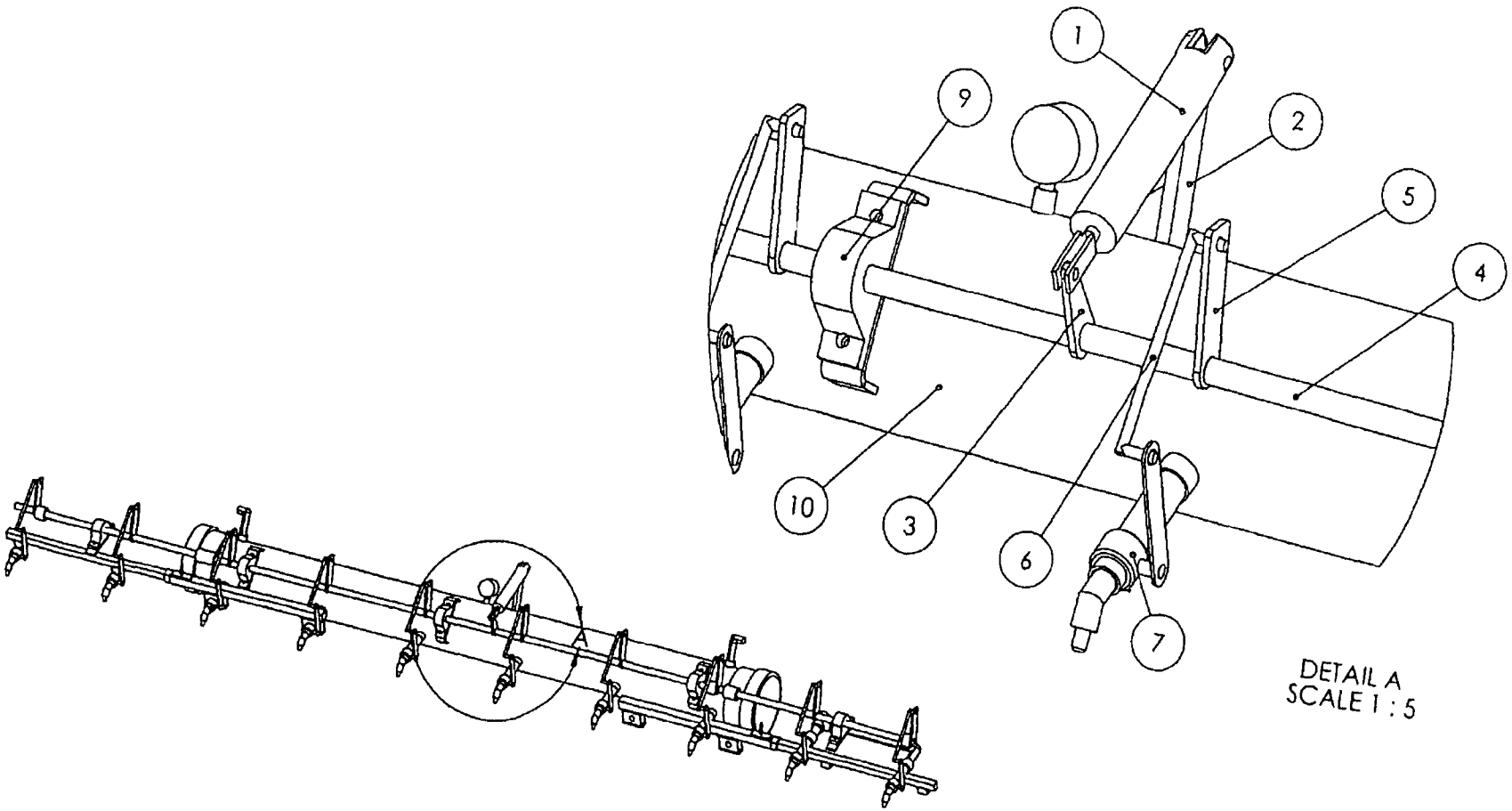
FIG. 3 Diagram of actuator on/off control.

Now refer to FIG. 3 unless otherwise noted. An actuator on/off spray feature is integrated into the spray apparatus as well. It consists of a mount (2) that attaches the actuator (1) to the external filter housing (10), a custom linkage (3) attaching the end of the actuator piston to a rotating shaft (4), and additional linkages (5,6) connecting the rotating shaft to the each valve (7) controlling the flow of the material through each spray nozzle. The placement of the rotating shaft is secured through bearings (9) attached to the external filter housing (10).

The invention claimed is:

1. A filter spray apparatus to be used with a paving system and material pump that distributes material towards the ground surface, comprising:

a horizontal cylindrical filter housing;

a cylindrical perforated filter screen enclosed in said filter housing;

detachable end pieces are attached to both ends of said cylindrical filter housing;

said horizontal cylindrical filter housing serves as a means to contain said cylindrical perforated filter screen and paving material;

a material inlet port located on the surface and in the center of said cylindrical filter housing;

multiple material outlet ports comprising multiple nozzle ball valves orientated towards the ground surface longitudinally aligned along said cylindrical filter housing;

a horizontal rotating bar is mounted to the external face of said cylindrical filter housing in multiple locations through bearings;

said horizontal rotating bar is the same length as said cylindrical filter housing and is mounted so that it is parallel with said cylindrical filter housing;

an actuator mounted onto the external face of said cylindrical filter housing;

said actuator is linked to said horizontal rotating bar whereby when said actuator is extended it rotates said horizontal rotating bar;

said multiple nozzle ball valves allow the outlet of material from said cylindrical filter housing and are individually linked to said horizontal rotating bar via quick release control linkages;

said quick release control linkages are connected to each individual said multiple nozzle ball valves and controls the outlet of material from said multiple nozzle ball valves;

said quick release control linkages are connected to said horizontal rotating bar;

said quick release control linkages can be individually released manually by hand thereby controlling the flow of material of individual said multiple nozzle ball valves when actuator is extended.

* * * * *